US005248036A

United States Patent [19]

Radocha, Sr. et al.

[11] Patent Number: 5,248,036

[45] Date of Patent: Sep. 28, 1993

[54] STRIP TYPE POINT-OF-SALE DISPLAY UNIT

[75] Inventors: Michael J. Radocha, Sr., Greenfield; Donald T. Crysdale, Shorewood; Larry K. Bauer, Madison, all of Wis.

[73] Assignee: The Merchandisers, Inc., Milwaukee, Wis.

[21] Appl. No.: 780,904

[22] Filed: Oct. 23, 1991

[51] Int. Cl.[5] ..... B65D 75/00

[52] U.S. Cl. ..... 206/479; 211/72; 211/113; 383/39

[58] Field of Search ..... 206/461, 466, 477–479, 206/481, 483, 495, 806, 820, 363, 480; 211/13, 72, 113, 118; 383/38–40

[56] References Cited

U.S. PATENT DOCUMENTS

| | | | |
|---|---|---|---|
| 2,281,237 | 4/1942 | Eckman | 206/480 |
| 3,294,134 | 12/1966 | Matross et al. | 383/39 |
| 3,931,885 | 1/1976 | Nahill et al. | 206/466 |
| 4,195,739 | 4/1980 | Sweet, III | 211/113 |
| 4,502,596 | 3/1985 | Saetre et al. | 206/466 |
| 4,947,987 | 8/1990 | Keenan | 383/40 |

FOREIGN PATENT DOCUMENTS

| | | | |
|---|---|---|---|
| 0005579 | 5/1902 | Denmark | 383/38 |
| 0752826 | 3/1933 | France | 206/479 |
| 1361093 | 4/1964 | France | 206/363 |
| 2433919 | 4/1980 | France | 211/113 |
| 0534020 | 2/1941 | United Kingdom | 206/479 |

*Primary Examiner*—Jimmy G. Foster

*Attorney, Agent, or Firm*—Andrus, Sceales, Starke & Sawall

[57] ABSTRACT

A point-of-sale display unit includes an elongate back panel and an elongate transparent front panel with a plurality of connecting strips spaced along and between the two panels for defining a plurality of channels or pockets each adapted for receiving one of a plurality of like articles. The top two connecting strips on the panels define a channel for receiving a header panel adapted for carrying identifying indicia or point-of-sale advertising. The point-of-sale display unit is adapted to be suspended from a hook, whereby a plurality of like articles are stored, displayed and dispensed from a single hook, utilizing a single header panel and minimizing the packaging requirements for each article.

18 Claims, 4 Drawing Sheets

STRIP TYPE POINT-OF-SALE DISPLAY UNIT

BACKGROUND OF THE INVENTION

1. Field of the Invention

The invention is related generally to point-of-sale display units and is specifically directed to a hanging point-of-sale display for displaying a plurality of like articles.

2. Description of the Prior Art

Point-of-sale display units are well known in the art. Many are adapted to be suspended from a hook at the end of an aisle or near a checkout counter in any of a variety of retail outlets. Typically, the display unit includes a header panel with a mounting hole in the header panel for receiving a hook from which the unit is suspended. In the prior art, the header panel is part of the package for the article. The consumer removes the header and package from the hook in order purchase the article contained therein.

There are several disadvantages to this type of point-of-sale display unit. In particular, each package must contain a separate header, requiring additional material and printing costs. Also, each package and integral header contains only the articles which the consumer purchases during a single transaction.

It is also known to provide clip strips, wherein an elongated piece of cardboard with various formed slots is adapted for receiving and holding a plurality of like articles which are removed from the strip at the point of sale. Typically, such strips are ideally suited for articles which have an integral clip or the like for attaching the article through the strip, such as decorative pins and the like.

Another disadvantage to the single header/package point-of-sale display unit is the requirement that the units be positioned in a "stacked" relationship on the hook, with only the front or forwardmost display unit being visible at any one time. In addition to minimizing the visual impact of the display, this often leads to the inability of stock clerks to determine at a glance the amount of stock left on the hook until after the last package has been removed.

SUMMARY OF THE INVENTION

The subject invention is directed to a novel point-of-sale display unit which overcomes the disadvantages of the prior art. Specifically, the point-of-sale display unit of the invention provides for displaying a plurality of individual articles in a single display unit utilizing a single header panel. All of the articles in the unit are visible when the display unit is suspended from a hook or the like.

Specifically, the point-of-sale display unit of the subject invention comprises an elongated back panel having a transparent front panel mounted thereon, and secured along spaced-apart strips to the back panel for defining a plurality of channels or pockets, each of which is adapted to receive one of a plurality of like articles. The channels for receiving and containing the articles to be displayed may be adapted for holding any of a plurality of articles regardless of shape, size and center of gravity. The top two strips in the panel define a rectangular channel for receiving a header panel. A mounting hole in the header panel and the two panels permits the display unit to be suspended from a hook or the like. The articles may be individually removed from each of the channels, whereby a consumer may select and purchase a single article, if desired. The display unit of the subject invention permits minimum packaging for the articles while taking advantage of a common header and a common, attractive display unit.

It is an important feature of the invention that the strip-type point-of-sale display unit displays the article in a desirable manner, permitting full view of the article and ready visual identification of the article by the consumer. The flexible strips which comprise the point-of-sale display unit of the subject invention are readily foldable both with the articles positioned in the various channels and before the articles are inserted, permitting flexible packaging and storage of the strips and of stock once the strips are utilized. The strip-type point-of-sale display units of the subject invention provide a unique system for storing, displaying and dispensing articles. The articles are maintained in a neat and attractive array arranged for ease of stock keeping while permitting maximum advertising content on the unit with minimum packaging requirements for the displayed articles. Restocking by the retailer at the point of sale is greatly minimized by requiring that only one point-of-sale display unit be replaced in order to display a plurality of like articles for sale, as opposed to the requirement that individual blister packs be separately and serially suspended from a hook or the like. The novel point-of-sale display unit of the subject invention provides a product display system uniquely adapted for keeping the stock organized, both during storage and when on display, while providing maximum visibility of the product at the time of display.

In the preferred embodiment, the display unit is a strip made of flexible, non-stretchable material such as vinyl or the like, wherein the articles may be loosely but frictionally held within the channels until removed by the consumer. The front panel of the display unit is transparent, whereby the articles are in full view when displayed.

The strips defining the channels or pockets between the back and front panel may either be straight, parallel connecting or securing strips for defining rectangular channels for holding any of a variety of rectangularly packaged articles or may be specifically contoured to conform to the outer perimeter of an article such as, by way of example, a paint brush or the like.

In one embodiment of the invention, the front panel and back panel are substantially the same size, and are spread apart to define a pocket or article receiving channel between connecting strips. In a second embodiment of the invention, the front panel is substantially longer than the back panel and is loosely secured to the back panel with common ends, with the strips for securing the back panel and front panel to one another defining a loose, enlarged pocket or channel for holding bulky articles.

In another embodiment of the invention, a three-ply unit is incorporated, wherein an intermediate or center panel includes a transparent panel on either side for defining pockets on both sides of the center panel, for doubling the number of articles contained on the display unit.

The strip-type point-of-sale display unit of the subject invention provides a novel display unit for visibly displaying a plurality of articles from a single hook, utilizing a single header and permitting maximum display of the articles while minimizing article packaging requirements.

It is, therefore, an object and feature of the subject invention to provide for a unique point-of-sale display for storing, displaying and dispensing a plurality of like articles.

It is yet another object and feature of the subject invention to provide for a point-of-sale display permitting a plurality of like articles to be displayed utilizing a single header panel.

It is a further object and feature of the subject invention to provide for a point-of-sale display unit for displaying a plurality of like article while minimizing the packaging requirements for each article.

It is another object and feature of the subject invention to provide for a point-of-sale display unit which maximizes the visibility of the display.

Other objects and features of the subject invention will be readily apparent from the accompanying drawings and description of the preferred embodiments.

DESCRIPTION OF THE PREFERRED EMBODIMENTS

Figure 1:
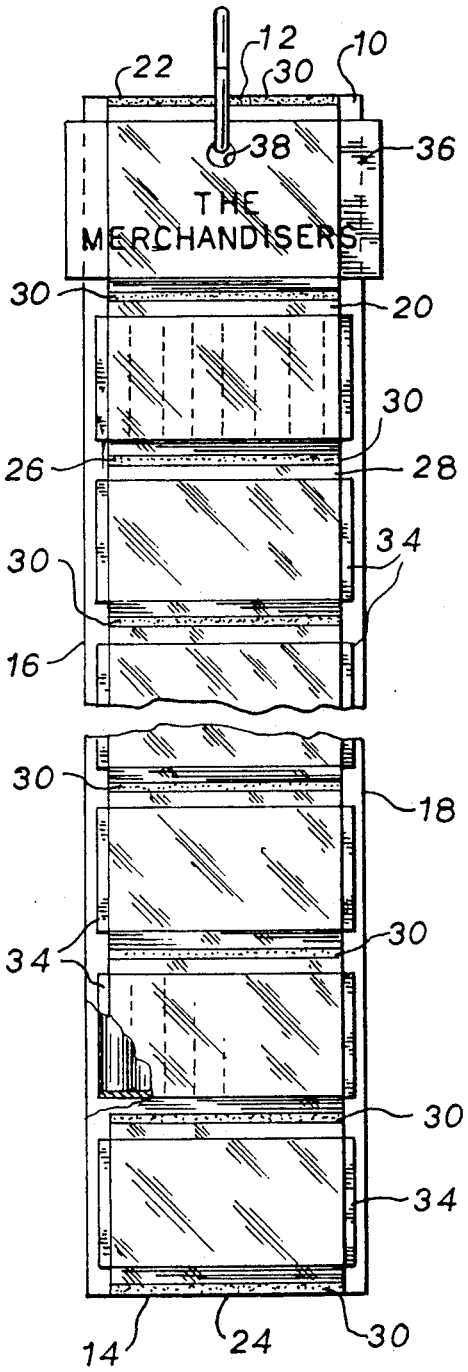
FIG. 1 is a front elevation view of a two-ply strip-type point-of-sale display unit having rectangular article channels.

A point-of-sale display unit in accordance with the subject invention is shown in FIG. 1. As there shown, the unit comprises a back panel 10 having opposite ends 12 and 14 and opposite sides 16 and 18. Preferably, the panel 10 is made of a flexible, non-stretchable material such as vinyl or the like and in the preferred embodiment an 8 mil vinyl sheet is used. In the embodiment shown in FIGS. 1–3, the front panel or over panel 20 is the same length as the back panel 10 and includes common ends 22 and 24 (see FIG. 2). In the embodiment shown, the sides 26 and 28 of the front panel 20 are disposed slightly inwardly of the respective sides 16 and 18 of the front panel 10. In the preferred embodiment, the outer panel 10 is constructed of a flexible, non-stretchable material such as 8 mil vinyl or the like and is transparent to provide full view of the articles container in the article channels.

Figure 2:
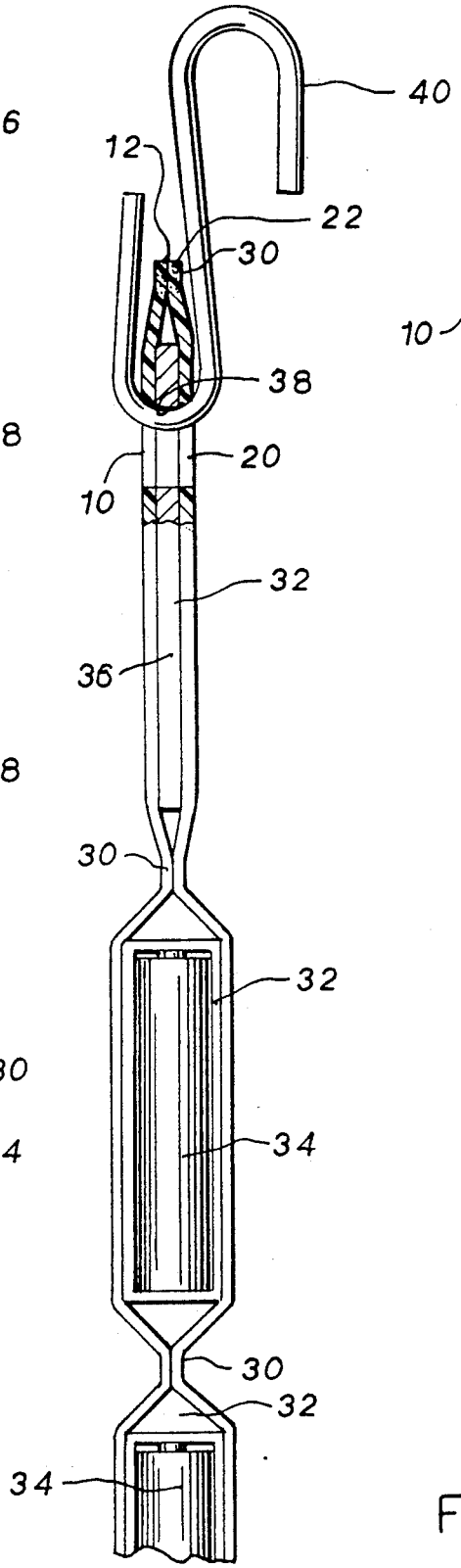
FIG. 2 is a fragmentary side view of the point-of-sale display unit of FIG. 1.
Figure 3:
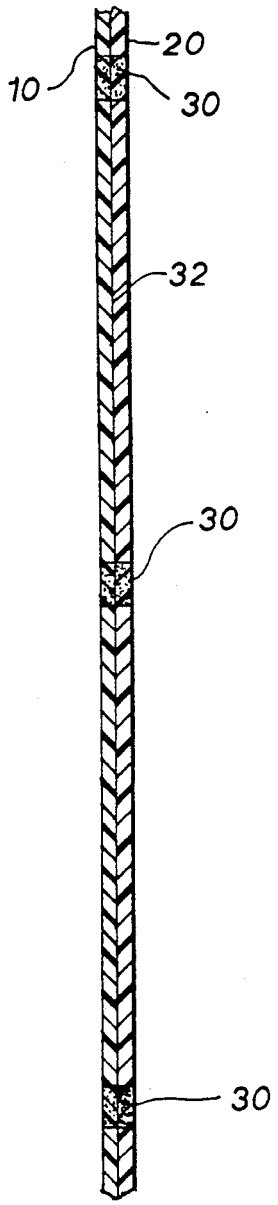
FIG. 3 is a cross-section of the point-of-sale display unit of FIG. 1, looking in the same general direction as FIG. 2 and showing the two-ply construction before any articles are inserted into the article receiving channels.

As more clearly shown in FIGS. 2 and 3, a plurality of connecting or securing strips 30 are provided in a spaced relationship along the panels 10 and 20 and in the embodiment of FIGS. 1–3 are substantially straight lines parallel to the respective ends 12, 14, 22 and 24 of the panels 10 and 20. In the preferred embodiment, the connecting strips 30 are dielectrically sealed in the manner well known to those skilled in the art, whereby the front and back panels are permanently bonded to one another. As will be understood, the securing means could comprise any suitable means such as, by way of example, a hot melt glue, a sonic welding technique may be employed, or the like. The space between each pair of adjacent connecting strips 30 defines a channel 32 between the panels 10 and 20. As is best shown in FIG. 2, the panels 10 and 20 may be spread apart between connecting strips 30 and an article 34 may be placed in each of the channels 32.

The connecting strip 30 which is adjacent to the ends 12, 22 of the panels 10, 20, respectively, and the next adjacent connecting strip 30 define a rectangular channel 32 specifically adapted for receiving a header panel 36 (see FIG. 1). The header panel 36 may include identifying indicia or other point-of-sale advertising. A mounting hole 38 is provided in the panels 10 and 20 and in the header panel 36. The mounting hole 38 is adapted for receiving a hook 40, from which the display unit may be suspended.

The embodiment of FIGS. 1–3 is ideally suited for storing, displaying and dispensing a plurality of like articles such as battery packs or the like. The display unit permits visual display of a plurality of like articles while utilizing a single header panel 36, at the same time minimizing the packaging required for each of the individual articles or article packs. The consumer slides an article from the respective channel in order to make a purchase.

Figure 4:
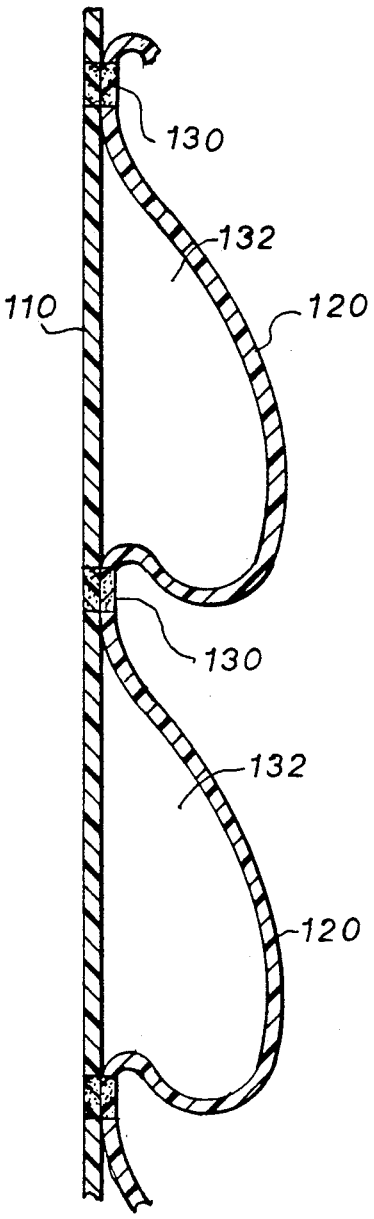
FIG. 4 is a cross-section of an alternative embodiment of the point-of-sale display unit looking in the same direction as FIG. 2, utilizing a front panel which is substantially longer than the back panel for providing enlarged article channels.
Figure 5:
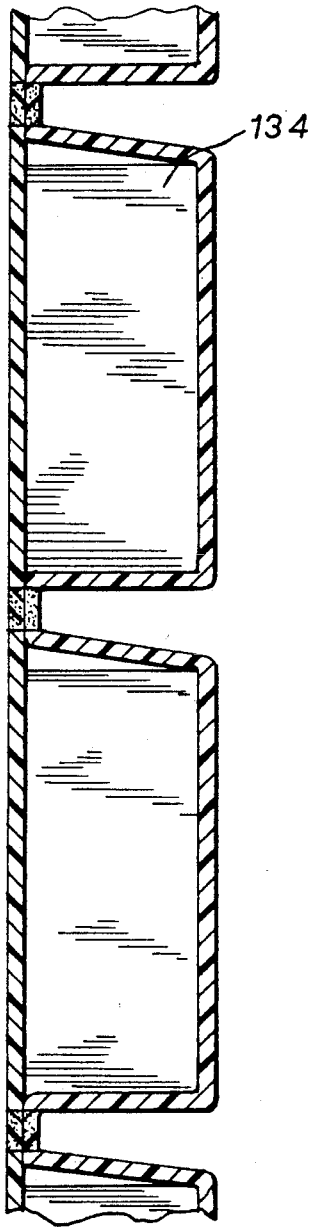
FIG. 5 is a view looking in the same direction as FIG. 4, showing the point-of-sale display unit after bulky articles have been inserted in each of the channels.

An alternative embodiment of the display unit is illustrated in FIGS. 4 and 5. As there shown, the front panel 120 is longer than the back panel 110, and the connecting strips 130 are disposed between panels 110 and 120 such that the panel 120 provides a loose, ballooned pocket or channel 132 adapted for receiving bulky articles 134, as shown in FIG. 5. This permits the point-of-sale display unit to be utilized with larger or bulky articles requiring more volume than that permitted by the configuration of FIGS. 1–3. The top two connecting strips (not shown) function in the same manner as that of FIGS. 1–3, wherein the front panel 120 is stretched tightly between the first two connecting strips for accommodating the header panel 36.

Figure 6:
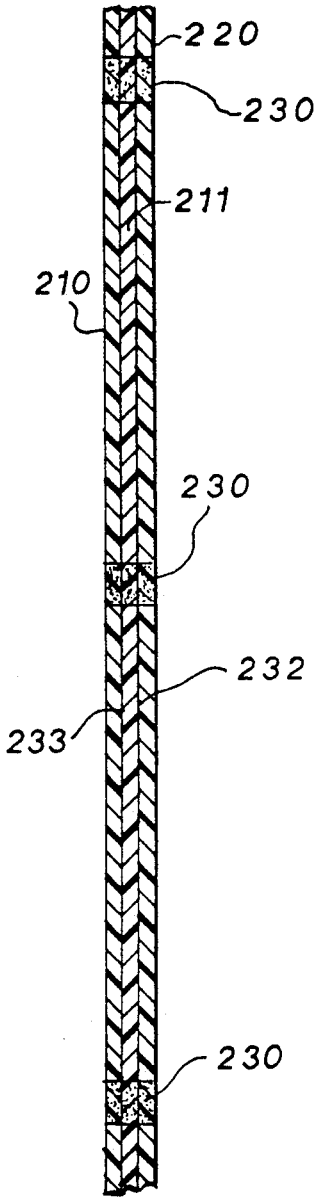
FIG. 6 is a fragmentary cross-section view looking in the same direction as FIG. 2 and showing a three-ply point-of-sale display unit in accordance with the subject invention.
Figure 7:
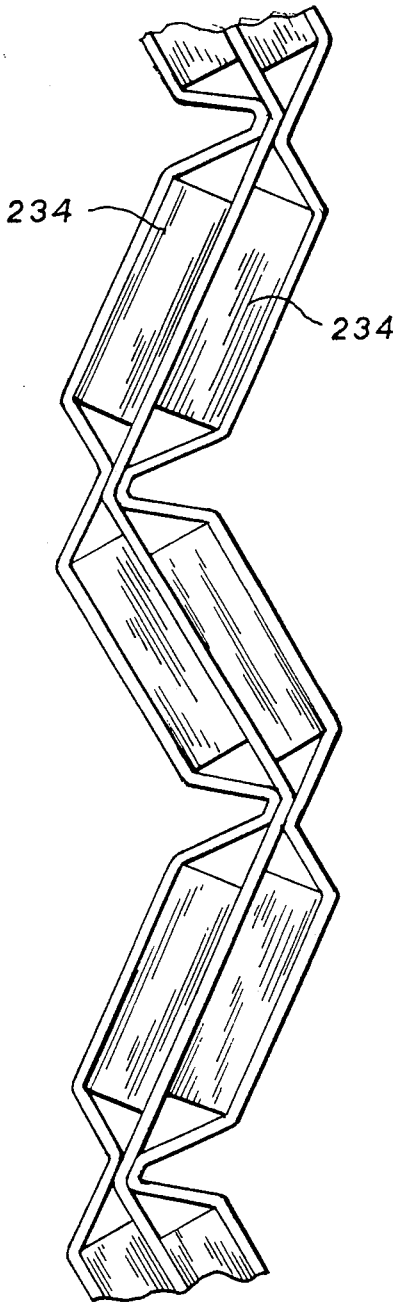
FIG. 7 is a fragmentary side view of the point-of-sale display unit of FIG. 6, after articles have been placed in the article receiving channels.

A third embodiment of the point-of-sale display unit is shown in FIGS. 6 and 7 and comprises a three ply structure, wherein the front panel 220 and the back panel 210 are separated by a center panel 211. The connecting strips 230 are spaced apart between the three panels for securing the three panels to one another in the same manner as FIGS. 1 and 2, wherein the space between adjacent connecting strips defines a plurality of channels 232 and 233. Channels 232 are disposed between the front panel 220 and the center panel 211, whereas the channels 233 are disposed between the back panel 210 and the center channel 211. As is particularly shown in FIG. 6, when articles 234 are placed in each of the channels 232 and 233, respectively, a zig-zag display effect results. It will be readily understood that the configuration of FIGS. 4 and 5 for bulky articles could also be readily adapted to a three ply structure similar to that shown in FIGS. 6 and 7.

Figure 8:
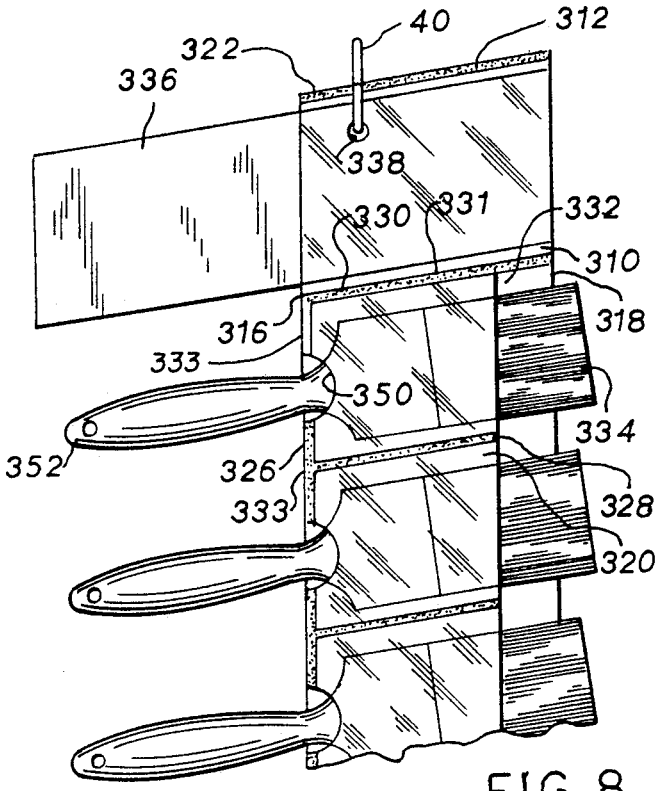
FIG. 8 is a view, similar to FIG. 1, showing an alternative construction for the article receiving channels.

The embodiment of FIG. 8 is a modification of the two ply embodiment, wherein the ends 312 and 322 intersect the panel sides 316, 318, 326 and 328 at an acute angle. The connecting strips 330 include a substantially straight run 331 parallel to the ends 312 and 322 and a substantially vertical run 333 for defining a channel 332 which corresponds to the outer perimeter of an article such as the base of the paint brush 334. In the embodiment of FIG. 8, a notch 350 is provided in front panel 320, for receiving the handle 352 of the paint brush, permitting the handle to extend outwardly from the point-of-sale display panels. In order to remove the paint brushes from the point-of-sale display unit, the bristle portion of the paint brush base is grasped by the consumer and the brush is slidably removed from the channel 332. The top two connecting strips of the embodiment of FIG. 8 are adapted to receive the modified header panel 336, in the manner previously described. As shown in FIG. 8, the mounting hole 338 is offset from the center of the display panels, accommodating for the position of the center of gravity of the article contained in the channels. This assures that the display unit hangs with the outer sides 316 and 318 in substantial vertical alignment when the display unit is hung from the typical hook 40.

Figure 9:
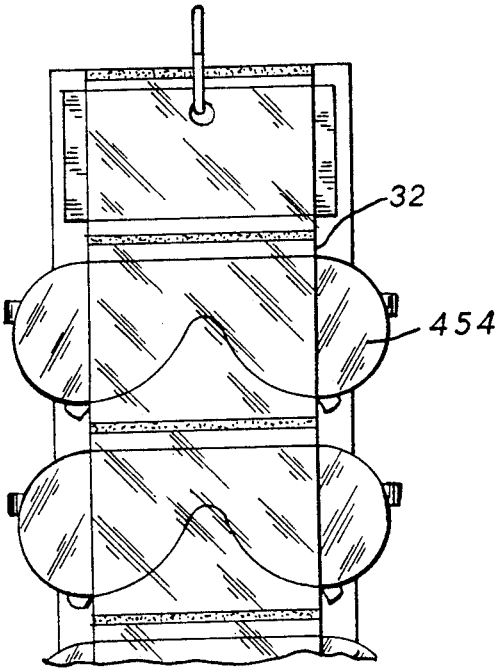
FIG. 9 is a view similar to FIGS. 1 and 8, showing alternative construction for the article receiving channels.

The embodiment of FIG. 9 shows the versatility of the construction of FIG. 1, including pockets or channels 32 which are adapted for carrying and displaying sunglasses 454 or the like.

Figure 10:
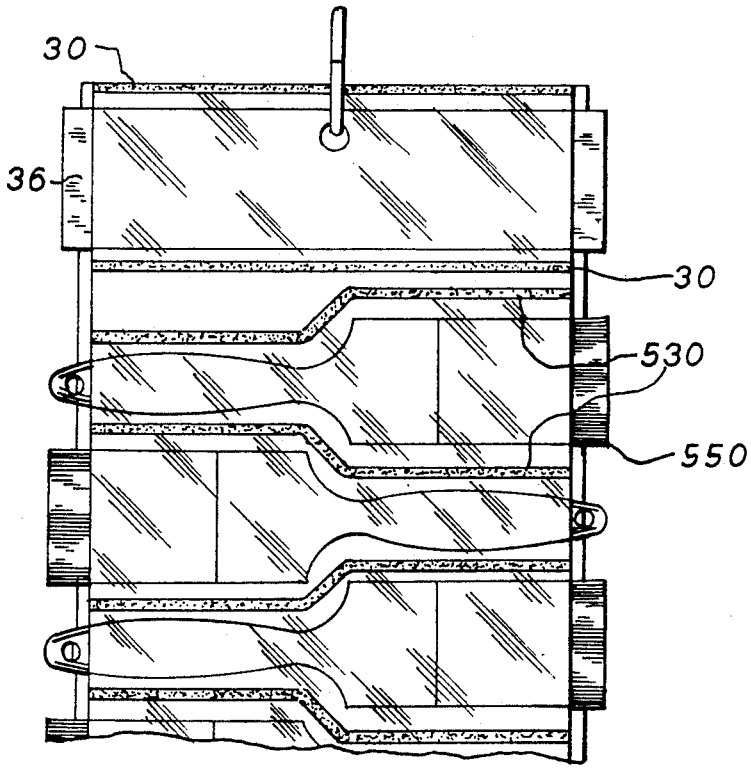
FIG. 10 is a view similar to FIG. 1, showing channel defining connecting strips which have been contoured to conform to the outer perimeter of a specific article.

FIG. 10 shows an embodiment incorporating the construction of FIGS. 4 and 5 for bulky articles, wherein the connecting strips 530 are contoured to correspond to the outline of a plurality of irregular shaped articles such as the paint brushes 550. As there shown, paint brushes may be positioned alternatively in the channels defined by the connecting strips 530, to minimize the amount of space required for displaying a plurality of like articles by minimizing the channel size required for each article.

Figure 11:
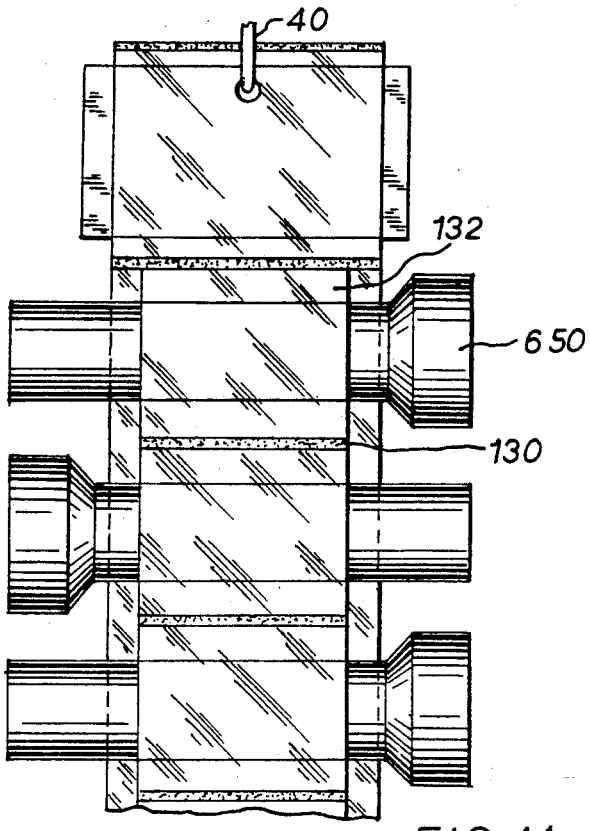
FIG. 11 is a view similar to FIG. 9, showing the point-of-sale display unit adapted for bulky articles.

The embodiment of FIG. 11 shows the utilization of the configuration of FIGS. 4 and 5, with straight connecting strips 130 and channels 132 adapted for receiving a bulky item such as flashlights 650, which may be positioned alternately in succeeding channels, as shown, to stabilize the center of gravity and assure that the display unit hangs in a substantially vertical position from the hook 40.

Figure 12:
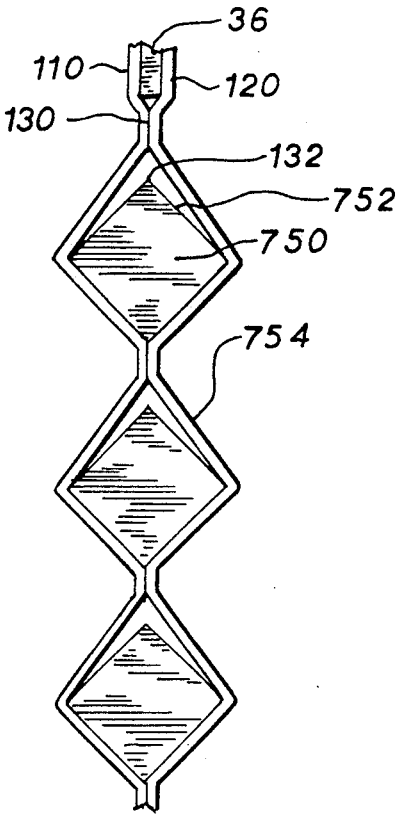
FIG. 12 is a cross-section view, similar to FIG. 2, showing the point-of-sale display unit for use in containing and displaying articles in a package of a substantially square cross-section.

The embodiment of FIG. 12 shows the configuration of FIGS. 4 and 5, when the article 750 is in a container of a substantially square cross-section. As there shown, when the containers 750 are inserted in the channels 130, the front surface 752 of each container 750 is at approximately a 45° angle with respect to a vertical line. This permits the front surface 752 of the article box 750 to be viewed through the angled portion 754 of the front panel 120, making the indicia on the box readily visible to the consumer.

While certain embodiments and features of the invention have been described in detail herein, it will be readily understood that the invention encompasses all modifications and enhancements within the scope and spirit of the following claims.

I claim:

1. A point of sale display unit for storing, displaying and dispensing a plurality of like articles having a similar peripheral shape for selection by a consumer, the display unit comprising:

a. an elongate back panel made of a flexible, non-stretchable material and including opposite sides and ends;

b. an elongate front panel made of a transparent, flexible, non-stretchable material and including opposite sides and ends, the back panel and the front panel being disposed in overlying relationship with the back panel ends and the front panel ends being disposed in overlying relationship with one another c. a center panel disposed intermediately of the front and back panels and having opposite sides and ends corresponding with the opposite sides and ends of the front and back panels; and d. means for permanently securing the front and back panels to the center panel along spaced apart strips intermediate the opposite sides thereof for defining a plurality of spaced sections of the front and back panels which are adapted to be spread apart between said strips for defining channels adapted for releasably receiving and substantially conforming to the peripheral shape of the articles.

2. The display unit of claim 1 wherein the front and back panels are larger than the center panel such that when the opposite ends of the front and back panels are placed in alignment with the opposite ends of the center panel and the panels are secured to one another along the spaced apart strips open channels are formed between the panels and between adjacent strips for defining a plurality of enlarged channels each adapted for receiving a bulky article.

3. The display unit of claim 1, wherein said back panel is made of a transparent material.

4. The display unit of claim 1, wherein each of said panels is made of an 8 mil single ply vinyl.

5. The display unit of claim 1, wherein said strips are each parallel to the opposite ends of said panels, whereby substantially rectangular channels are formed.

6. The display unit of claim 1, wherein said strips are contoured to form a shaped channel adapted for receiving and conforming to a contoured periphery on an article placed in said channels.

7. The display unit of claim 6, wherein there are included at least four strips and an adjacent pair of said strips are substantially parallel, spaced apart straight lines for defining a rectangular channel, the display unit further including a rectangular header panel placed in said rectangular channel.

8. The display unit of claim 7, further including a mounting hole through each of said elongate panels and said header panel between said parallel strips, whereby the display unit may be suspended from a hook.

9. The display unit of claim 1, wherein there are included at least four strips and an adjacent pair of said strips are substantially parallel, spaced apart straight lines for defining a rectangular channel, the display unit further including a rectangular header panel placed in said rectangular channel.

10. The display unit of claim 9, further including a mounting hole through each of said elongate panels and said header panel between said parallel strips, whereby the display unit may be suspended from a hook.

11. The display unit of claim 10, wherein said mounting hole is located equidistant from the opposite sides of the back panels.

12. The display unit of claim 10, wherein said mounting hole is offset from the center of said panels such that the sides of said unit a maintained in a substantially vertical alignment when the display unit channels are filled with articles having an offset center of gravity.

13. The display unit of claim 9, wherein said header is made of a semi-rigid, non-stretchable material.

14. The display unit of claim 1, wherein each of said strips is a substantially straight line and is substantially parallel with said ends of said panels for defining a plurality of substantially rectangular channels.

15. The display unit of claim 1, wherein said securing means is a dielectric bond between panels.

16. The display unit of claim 1 wherein one side of at least one of said front and back panels includes a plurality of spaced apart notches along a side thereof, one each disposed in one of said channels, for facilitating removal of an article from a channel.

17. The display unit of claim 1, wherein said ends are parallel non-orthogonal with the respective sides for defining a plurality of channels which are parallelograms.

18. The display unit of claim 1 wherein the sides of said front and back panels are disposed inwardly of the respective sides of said center panel.

* * * * *